US011891755B2

(12) United States Patent
Zhang et al.

(10) Patent No.: US 11,891,755 B2
(45) Date of Patent: Feb. 6, 2024

(54) PREPARATION METHOD OF SAFETY GLOVES WITH SPECIAL COATING

(71) Applicant: ZheJiang Kang Long Da Special Protection Technology Co., Ltd., Shaoxing (CN)

(72) Inventors: Jianfang Zhang, Shaoxing (CN); Jiadi Zhang, Shaoxing (CN); Huajun Zheng, Shaoxing (CN)

(73) Assignee: ZHEJIANG KANG LONG DA SPECIAL PROTECTION TECHNOLOGY CO., LTD., Shaoxing (CN)

( * ) Notice: Subject to any disclaimer, the term of this patent is extended or adjusted under 35 U.S.C. 154(b) by 416 days.

(21) Appl. No.: 17/228,803

(22) Filed: Apr. 13, 2021

(65) Prior Publication Data

US 2021/0317610 A1 Oct. 14, 2021

(30) Foreign Application Priority Data

Apr. 14, 2020 (CN) ..... 202010288904.4

(51) Int. Cl.
*D06N 3/00* (2006.01)
*D06N 3/04* (2006.01)
(Continued)

(52) U.S. Cl.
CPC ..... *D06N 3/0059* (2013.01); *A41D 19/0006* (2013.01); *A41D 19/01505* (2013.01);
(Continued)

(58) Field of Classification Search
CPC .... D06N 3/0059; D06N 13/256; D06N 15/53; D06N 3/045
See application file for complete search history.

(56) References Cited

U.S. PATENT DOCUMENTS 6,968,982 B1 * 11/2005 Burns ..... B65D 83/26 222/137
8,119,200 B2 * 2/2012 Kassam ..... B29C 41/14 427/337

(Continued)

*Primary Examiner* — Dah-Wei D. Yuan
*Assistant Examiner* — Kristen A Dagenais
(74) *Attorney, Agent, or Firm* — McClure, Qualey & Rodack, LLP

(57) ABSTRACT

The present invention relates to safety gloves with special rubber coating. Specifically, a kind of safety gloves with rubber coating which is specially designed and coated on fabric substrates to achieve proper hand protection effects, and exhibits properties such as good ventilation, abrasion resistance, and soft and comfortable wearing experience. A preparation method of safety gloves with special coating, comprising following steps: (1) treating a substrate with composite electrolyte digestion solution by a certain method; (2) spreading polymeric disperse coating over the substrate containing composite electrolyte digestion solution obtained in step (1), heating when the polymeric disperse coating is attached and obtaining a half-product with polymeric disperse coating; (3) treating the half-product with polymeric disperse coating in pre-foamed water chemical compound or non-foamed water chemical compound, by treating immersing or spraying or immersing and spraying is defined; and (4) dipping the product treated in step (3) in aromatic hydrocarbon solution.

1 Claim, 1 Drawing Sheet

(51) Int. Cl.

| | |
|---|---|
| ***D06N 3/10*** | (2006.01) |
| ***A41D 19/00*** | (2006.01) |
| ***A41D 19/015*** | (2006.01) |
| ***D06M 13/256*** | (2006.01) |
| ***D06M 15/53*** | (2006.01) |
| *D06M 101/34* | (2006.01) |

(52) U.S. Cl.
CPC ..... *D06M 13/256* (2013.01); *D06M 15/53* (2013.01); *D06N 3/045* (2013.01); *D06N 3/10* (2013.01); *D06M 2101/34* (2013.01); *D06N 2209/1685* (2013.01); *D06N 2211/103* (2013.01)

(56) References Cited

U.S. PATENT DOCUMENTS

2012/0070647 A1* 3/2012 O'Neill ..... D06N 3/14
427/2.1
2014/0199359 A1* 7/2014 Chason ..... A01N 59/20
514/495

* cited by examiner

PREPARATION METHOD OF SAFETY GLOVES WITH SPECIAL COATING

TECHNICAL FIELD

The present invention relates to a kind of safety gloves with special rubber coating. Specifically, a kind of safety gloves with rubber coating which is specially designed and coated on fabric substrates to achieve proper hand protection effects, and exhibits properties such as good ventilation, abrasion resistance, and soft and comfortable wearing experience.

BACKGROUND TECHNOLOGY

Hand protection products are important in ensuring personal safety throughout a variety of industries and application fields. Many different kinds of gloves are developed for protecting hands and articles at a worksite by manufacturers and designers depending on physical conditions of different working environments, such as moisture, grease, oil, solution and dryness etc. In addition, attention is also paid to wearing comfort and ease besides protecting hands of users.

In recent years, application of safety protection gloves by terminal users is wide, and consequently, development on safety gloves and coatings and fabrics thereof is more and more popular. Demands on the safety gloves change with properties desired for specific application situations. However, all over the world, there are a number of different fabricators and manufacturers producing all kinds of coatings with different processes. Among them, a lot of processes may cause serious impacts on the environment. In the meantime, gloves commercially available now cannot meet demands from the wearers on comfortableness and convenience.

In 1883, the first hand protection gloves are made by cooperation of William Stewart Halsted from Johns Hopkins Hospital located in Baltimore, the US and a US company Goodyear Rubber Company. William Stewart Halsted said that, safety gloves were used to protect hands of medical personnel. Nowadays, safety protection gloves have become a common safety necessity, as people attach more and more importance on hand injuries, stains, infection and compatibilities to surfaces of handheld objects.

Marco Antonio said in CN206197147 that, some gloves have a foamed polymeric coating to impart flexibility and other comfort-related properties. And he also said that, a rubber polymer comprises natural rubber latex and synthetic rubber latex, which can be dipped onto different kinds of fabric liners.

Ellaine Dillard established importance of polymeric foam coatings in textile supported foam gloves, which provides a gripping mode different from conventional ones, in US20040221364A. Ellaine Dillard further explained that, when mixing with the base polymer, air can lower density of the base polymer such as acrylonitrile butadiene rubber, neoprene rubber and natural latex and chemicals. Ellaine Dillard explained to air dry composite electrolyte dispersion with surface active agents by dipping into curing solution. Furthermore, he has described distribution conditions and maintenance of air cells in the polymeric compound.

D Narasinhan in CN102754946A referred to US patents (U.S. Pat. Nos. 4,569,707 and 4,589,940), which disclosed methods for making foamed surfaces, and further described foaming method by a mechanical or chemical means. Furthermore, he specified polymer materials such as polyurethane, polyvinyl chloride (PVC), acrylonitrile, natural rubber and synthetic rubber. Foaming is done prior to applying the polymer material to a liner of eligible foamed air content. Furthermore, he has also defined abrasion resistance and foamed air content.

John Taylor said in his application 2006DN05580A that, polymer materials such as NBR latex, natural latex, polyurethane rubber latex, neoprene rubber, and polyvinyl acetate (PVA) can be used as foaming polymeric materials for application to a fabric substrate. Jennath Rubi said in PCT patent publication number WO2017/197429A2 that, mechanical agitation of the polymer dispersion is necessary, and aeration generation in the foams comes from improvement of personal protection standard and environmental protection standards designed for manufacturers.

To meet higher commercial demands, environmental protection requirements shall be taken into consideration during safety gloves manufacturing, and it appears to be very important how to select an alternative coating of wearing comfort.

SUMMARY OF THE INVENTION

To address deficiencies appeared in the prior art, the present invention provides a preparation method of safety gloves with special coating, which comprises:

(1) Treating a substrate with composite electrolyte digestion solution by a certain method, and obtaining the substrate containing composite electrolyte digestion solution. The certain method is one or any combination of hybrid dispersion soaking, dipping, and spraying, and temperature of the composite electrolyte digestion solution is 10° C.-60° C.

In the present invention, the substrate of fabric can absorb chemicals from the composite electrolyte digestion solution during soaking, dipping and spraying. The substrate soaked in composite electrolyte digestion solution will react with an inner surface of polymeric disperse coating.

(2) Applying polymeric disperse coating to the substrate containing composite electrolyte digestion solution, and heating when the polymeric disperse coating is attached to the substrate, to obtain a half-product with the polymeric disperse coating; in this process, a still sticky and partly gel containing polymer layer will be formed on the substrate. And this can be done in ambient room or air temperature with a blower system.

(3) Treating the half-product with the polymeric disperse coating obtained in step (2) with pre-foaming water chemical compounds or non-foamed water chemical compounds, by treating it is defined to immerse or spray or immerse and spray.

By the above treatment, air holes can be formed in coating surface.

(4) Dipping or spraying the product treated in step (3) in aromatic hydrocarbon solution. By dipping in or spraying with the aromatic hydrocarbon solution, air holes can be formed in coating surface.

The substrate in step (1) is natural fiber or chemical fiber.

The substrate in step (1) is any one or combination of nylon, cotton, Lycra, ultra-high-molecular-weight polyethylene (UHMWPE), aramid fiber, p-aramid fiber, acrylic acid, steel wire, glass, glass fiber, polyethylene and polyester.

The composite electrolyte digestion solution in step (1) is waterborne or ethanol containing liquid, and can also be a mixture of the above mentioned two liquids.

The composite electrolyte digestion solution in step (1) is a combination of calcium carbonate, polyethyleneglycol, dialkyl sulfonate, organic acid and alkali salt, a combination of inorganic acid, and alkali salt, a combination of organic acid and inorganic acid, a combination of organic salt and organic acid, a combination of organic salt and inorganic acid, a combination of organic acid and inorganic salt or a combination of inorganic salt and inorganic acid, and any combination of the foregoing substances.

The composite electrolyte digestion solution in step (1) is a combination of organic acid and organic salt, a combination of inorganic salt and calcium carbonate, a combination of polyethyleneglycol and dialkyl sulfonate and obtained by solving the foregoing substance combinations in kalinous water solution or pH modified ethanol medium.

The certain method in step (1) is immersing, and immersing time is 5 seconds to 20 seconds. Immersing time in step (1) is 10 seconds.

Temperature of the composite electrolyte digestion solution in step (1) is 10-30° C. When temperature of the composite electrolyte digestion solution is in this range, curing of the polymeric disperse coating added in step (2) can be done conveniently, and a uniquely foamed gel film will be formed on the substrate (it works when temperature of the composite electrolyte digestion solution is 10-60° C., but it works better when the temperature is 10-30° C.).

Before going to step (2), wash the substrates containing composite electrolyte digestion solution obtained in step (1). Washing can be done with industrial cleaning agents.

The polymeric disperse coating in step (2) is any one or mixture of natural rubber latex, polyisoprene, chloronorgutta, neoprene, polyvinyl acetate (PVA), nitrile rubber, waterborne polyurethane, solvent-borne polyurethane, polyvinyl chloride (PVC), polybutene, Poly(methyl methacrylate) (PMME), phenyl ethylene, siloxane, styrene-butadiene rubber, polystyrene-butylene glycol-styrene, ethylene propylene diene monomer (EPDM) or polybutylenes. Two kinds of polymeric disperse coatings can be foamed by a mechanical means individually or can be used directly omitting foaming process. Foaming by a mechanical means can be done by mechanical agitation, aeration or air discharge or any mixture of the foregoing methods. No requirement is on mixing proportion or the mixing proportion can be determined depending on actual conditions, preferably 30:70 and 20:80. Given desired properties of final products, the polymeric disperse coating can be sulphur, zinc oxide, rubber accelerators, filling materials, toners, surface active agents, thickening agents and foaming agents.

The polymeric disperse coating in step (2) is nitrile-butadiene rubber, carboxyl acrylonitrile-butadiene rubber or a mixture of natural rubber-poly(methyl methacrylate) and carboxyl acrylonitrile rubber.

Viscosity of the polymeric disperse coatings in step (2) are 100-20000 centipoises.

Viscosity of the polymeric disperse coatings in step (2) are 500-7000 centipoises.

The polymeric disperse coatings in step (2) are not foamed, partially foamed or fully foamed.

The polymeric disperse coatings in step (2) are foamed and adopts any one or both of mechanical or chemical foaming.

Heating temperature in step (2) is 40-80° C., and heating time is 1-30 minutes.

Heating temperature in step (2) is 50-60° C., and heating time is 1-2 minutes.

Spraying manner in step (3) is gravity spraying.

In step (3), when soaking the half-product with polymeric disperse coating in the pre-foaming water chemical compound, the pre-foaming water chemical compound is sprayed with low pressure over the polymeric disperse coating for 30 seconds to 10 minutes.

In step (3), when soaking the half-product with polymeric disperse coating in the pre-foaming water chemical compound, the pre-foaming water chemical compound is sprayed with low pressure over the polymeric disperse coating for 30 seconds to 120 seconds. By giving the foregoing treatment, air pores can be formed in surface of the coatings to a better extent.

The pre-foamed water chemical compound in step (3) is made of surface active agents.

The pre-foamed water chemical compound or non-foamed water chemical compound in step (3) includes anti-bacterial agents.

The aromatic hydrocarbon solution in step (4) is alcohol solution.

The fabric substrate shall be worn on a hand mold, or a mold of any shape. An article for modifying shape of the hand mold can be prepared for such as making minor adjustment to the hand shape so as to weave a proper fabric substrate. A substrate shall be comfortable for the users, also impart flexibility, water or sweat absorption abilities, vaporize absorbed water or sweat, and offer potential cutting protection. The cutting protection requirements comprise personal protection standards as per EN388 and ASTM. In the meantime, the final product shall provide puncture and tearing protection, coldness and high temperature protection, which is as stipulated in personal protection standards of EN 388 standards. Given service life of gloves, a good wear resistance property as per personal protection standards EN388 or ASTM is necessary.

For people working in gardening, food production, a variety of industries, agricultures, fishing, painting, automobile and wood work, it is necessary to protect hands from foreign matters such as water, lubricants, gases, chemicals, soil, food and rejects etc. Furthermore, they have to protect their hands from exposure in all kinds of environmental conditions such as moisture, oiliness and dryness; in addition, gloves shall offer wearing comfort together with protection to the greatest extent. Meanwhile, gloves shall protect subjects to be treated as well. In the present invention, all of the foregoing necessities are met, and many features are integrated. The present invention has a unique advantage, that is, a thin film layer, more advantageous grip strength, soft texture, and a rubber coating that can be applied to different types of substrates. Candidates for the substrates comprises a wide range, such as nylon, cotton, Lycra, UHMWPE, aramid fiber, p-aramid fiber, acrylic acid, steel wires, glasses, glass fibers, polyethylene and polyesters etc. what's more, spinning techniques such as knitting, stranding, cladding, cheese winding and dyeing are applicable to the safety gloves prepared according to the present invention.

The safety gloves prepared according to the present invention can provide ultimate abrasion resistance properties, which go beyond European abrasion resistance standards in EN388-2016, and no hole appears in the safety gloves until 25000 turns.

EMBODIMENTS

Embodiment 1

Figure 1:
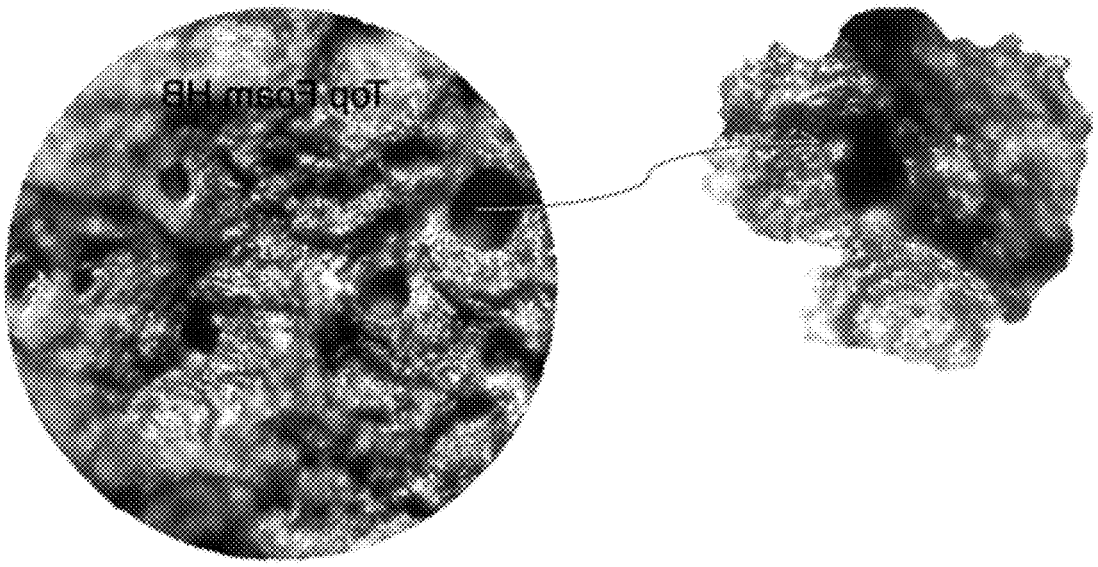
FIG. 1 is a microscopic scanning diagram of the polymeric disperse coating in step (2) according to embodiment 1 of the present invention.
Figure 2:
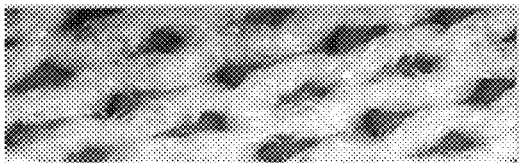
FIG. 2 is a microscopic scanning diagram of the substrate in step (1) according to embodiment 1 of the present invention.
Figure 3:
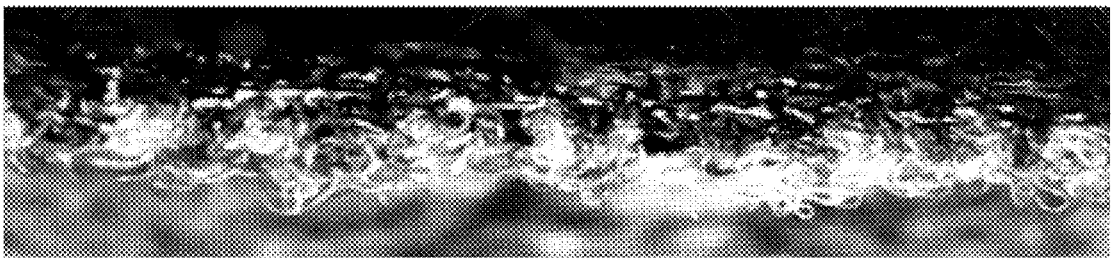
FIG. 3 is a microscopic scanning diagram of the half-product with polymeric disperse coating in step (2) according to embodiment 1 of the present invention.

(1) Treating a substrate with composite electrolyte digestion solution by a certain method to get the substrate containing composite electrolyte digestion solution. The certain method is defined as any one or a combination of hybrid disperse soaking, dipping and spraying;

(2) Spreading a polymeric disperse coating on the substrate containing composite electrolyte digestion solution obtained in step (1), heating when the polymeric disperse coating is successfully attached to obtain a half-product applied with the polymeric disperse coating.

(3) Treating the half-product applied with the polymeric disperse coating obtained in step (2) in a pre-foamed water chemical compound or non-foamed water chemical compound, by treating specifically dipping and spraying is defined; (4) soaking a product treated in step (3) in aromatic hydrocarbon solution or spraying the same with aromatic hydrocarbon solution.

In step (1), the substrate is nylon.

In step (1), the composite electrolyte digestion solution is a combination of polyethyleneglycol and dialkyl sulfonate and obtained by solving the foregoing substance combinations in kalinous water solution or pH modified ethanol medium.

In step (1), the certain method is dipping, and dipping time is 10 seconds.

In step (1), temperature of the composite electrolyte digestion solution is 10-30° C.

Before going to step (2), cleaning the substrate containing composite electrolyte digestion solution obtained in step (1).

In step (2), the polymeric disperse coating is EPDM and polybutene. The two polymeric disperse coatings can be foamed by a mechanical means respectively. Mixing proportion thereof can be 50:50, preferably 30:70 and optimum 20:80 depending on desired outcomes.

The polymeric disperse coating in step (2) is a combination of natural rubber-poly(methyl methacrylate) and carboxyl acrylonitrile rubber.

In step (2), viscosity of the polymeric disperse coating is 500-5000 centipoises.

In step (2), all of the polymeric disperse coating is foamed and in a mechanical means.

In step (2), heating temperature is 50-60° C., and heating time 1-2 minutes.

In step (3), the spraying manner is gravity spraying.

In step (3), when dipping the half-product applied with the polymeric disperse coating in a pre-foamed water chemical compound, the pre-foamed composite solution is sprayed to the polymeric disperse coating with low pressure for 30 to 120 seconds.

In step (4), the aromatic hydrocarbon solution is defined as alcohol solution.

Embodiments 2-3 (For Illustrating Influences to the Present Invention by Different Treatment Methods of the Pre-Foamed Water Chemical Compound)

All other conditions remain the same as embodiment 1, except treatment methods of the pre-foamed water chemical compound, specifically as following:

| | Treatment method of the pre-foamed water chemical solution | Product classification |
|---|---|---|
| Embodiment 1 | Dipping and spraying the water chemical compound | Excellent |
| Embodiment 2 | Dipping the water chemical compound | Good |
| Embodiment 3 | Spraying the water chemical compound | Good |

The invention claimed is:

1. A preparation method of safety gloves with special coating, characterized in that, comprising following steps:

(1) treating a substrate with composite electrolyte digestion solution by a certain method, and obtaining the substrate containing composite electrolyte digestion solution; the certain method is one or any combination of hybrid dispersion soaking, dipping, and spraying, and temperature of the composite electrolyte digestion solution is 10° C.-60° C.;

(2) applying polymeric disperse coating to the substrate containing composite electrolyte digestion solution, and heating when the polymeric disperse coating is attached to the substrate, to obtain a half-product with polymeric disperse coating;

(3) treating the half-product with polymeric disperse coating obtained in step (2) with pre-foaming water chemical compounds or non-foamed water chemical compounds, and by treating, immersing or spraying or immersing and spraying is defined; and (4) dipping or spraying the product treated in step (3) in aromatic hydrocarbon solution;

wherein in step (1) the composite electrolyte digestion solution comprises a combination of organic acid and organic salt; a combination of inorganic salt and calcium carbonate and a combination of polyethyleneglycol and dialkyl sulfonate and obtained by solving the foregoing substance combinations in kalinous water solution or pH modified ethanol medium.

* * * * *